US009353980B2

(12) United States Patent
Ignatiev

(10) Patent No.: US 9,353,980 B2
(45) Date of Patent: May 31, 2016

(54) CLIMATE-CONTROL SYSTEM HAVING MULTIPLE COMPRESSORS

(71) Applicant: Emerson Climate Technologies, Inc., Sidney, OH (US)

(72) Inventor: Kirill M. Ignatiev, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 146 days.

(21) Appl. No.: 14/267,224

(22) Filed: May 1, 2014

(65) Prior Publication Data

US 2014/0326018 A1 Nov. 6, 2014

Related U.S. Application Data

(60) Provisional application No. 61/818,684, filed on May 2, 2013.

(51) Int. Cl.
*F25B 5/00* (2006.01)
*F25B 6/00* (2006.01)
(Continued)

(52) U.S. Cl.
CPC ..... *F25B 49/02* (2013.01); *F25B 9/008* (2013.01); *F25B 2309/061* (2013.01); *F25B 2341/0662* (2013.01); *F25B 2400/075* (2013.01); *F25B 2400/13* (2013.01); *F25B 2400/23* (2013.01);
(Continued)

(58) Field of Classification Search
CPC ..... F25B 5/00; F25B 6/00; F25B 7/00; F25B 9/008; F25B 49/02; F25B 2400/13; F25B 2600/2501; F25B 2700/19; F25B 2400/23; F25B 2309/061; F25B 2400/075
USPC ..... 62/510, 527, 513
IPC ..... F25B 5/00,6/00, 7/00, 9/008, 49/02, F25B 2400/13, 2600/2501, 2700/19, 2400/23, F25B 2309/061, 2400/075
See application file for complete search history.

(56) References Cited

U.S. PATENT DOCUMENTS 4,209,998 A * 7/1980 Shaw ..... F04C 23/003 417/237
4,532,854 A * 8/1985 Foster ..... F03C 1/045 91/472

(Continued)

FOREIGN PATENT DOCUMENTS

WO WO-2008079128 A1 7/2008
WO WO-2008140454 A1 11/2008

OTHER PUBLICATIONS

International Search Report regarding Application No. PCT/US2014/036592, mailed Sep. 1, 2014.

(Continued)

*Primary Examiner* — Mohammad M Ali
(74) *Attorney, Agent, or Firm* — Harness, Dickey & Pierce, P.L.C.

(57) ABSTRACT

A system may include first and second compressors and first, second and third heat exchangers. The first heat exchanger may receive working fluid discharged from the first and second compressors. The second heat exchanger may be disposed downstream of the first heat exchanger and may provide working fluid to the first compressor. The third heat exchanger may be disposed between the first and second heat exchangers and may include an inlet and first and second outlets. The first outlet may provide working fluid to the second heat exchanger. The second outlet may provide working fluid to the second compressor.

27 Claims, 2 Drawing Sheets

(51) Int. Cl.
*F25B 7/00* (2006.01)
*F25B 9/00* (2006.01)
*F25B 49/02* (2006.01)

(52) U.S. Cl.
CPC ..... *F25B 2600/2501* (2013.01); *F25B 2700/19* (2013.01)

(56) References Cited

U.S. PATENT DOCUMENTS 5,095,712 A * 3/1992 Narreau ..... F25B 1/10 62/113
6,231,316 B1 * 5/2001 Wakisaka ..... F04C 28/12 417/310
7,721,562 B2 * 5/2010 Lifson ..... B60H 1/3216 62/196.2
7,874,499 B2 * 1/2011 Lochtefeld ..... F24F 3/06 236/44 C
8,020,402 B2 * 9/2011 Pham ..... F04C 29/042 62/324.1
8,091,381 B2 1/2012 Boiarski et al.
8,713,963 B2 5/2014 Yanik
2002/0187050 A1 * 12/2002 Narney, II ..... F04C 28/16 417/53
2005/0235664 A1 * 10/2005 Pham ..... F04C 28/00 62/126
2008/0078192 A1 * 4/2008 Ignatiev ..... F25B 1/10 62/184
2008/0245505 A1 * 10/2008 Yamaguchi ..... F25B 1/10 165/63
2009/0297377 A1 * 12/2009 Stover ..... F04C 28/265 418/55.1
2010/0132399 A1 * 6/2010 Mitra ..... F25B 9/008 62/498
2010/0199715 A1 8/2010 Lifson et al.
2010/0263393 A1 * 10/2010 Chen ..... F25B 1/10 62/115
2011/0023514 A1 * 2/2011 Mitra ..... F25B 1/10 62/222
2011/0048041 A1 * 3/2011 Asprovski ..... F25B 1/10 62/115
2011/0094259 A1 * 4/2011 Lifson ..... F25B 1/10 62/510
2011/0135509 A1 * 6/2011 Fields ..... F04C 18/0215 417/310
2011/0138825 A1 * 6/2011 Chen ..... F25B 1/10 62/115
2011/0139794 A1 * 6/2011 Pham ..... F04C 29/042 220/565
2011/0144944 A1 * 6/2011 Pham ..... F04C 28/00 702/182
2011/0174014 A1 * 7/2011 Scarcella ..... F25B 1/10 62/510
2012/0117988 A1 * 5/2012 Mitra ..... F25B 1/10 62/115
2012/0167602 A1 7/2012 Taras et al.
2012/0227427 A1 * 9/2012 Liu ..... F25B 1/10 62/115
2012/0285185 A1 * 11/2012 Huff ..... F25B 1/10 62/115
2012/0318008 A1 * 12/2012 Liu ..... F25B 9/008 62/115

OTHER PUBLICATIONS

Written Opinion of the International Searching Authority regarding Application No. PCT/US2014/036592, mailed Sep. 1, 2014.

* cited by examiner

CLIMATE-CONTROL SYSTEM HAVING MULTIPLE COMPRESSORS

CROSS-REFERENCE TO RELATED APPLICATIONS

This application claims the benefit of U.S. Provisional Application No. 61/818,684, filed on May 2, 2013. The entire disclosure of the above application is incorporated herein by reference.

FIELD

The present disclosure relates to a climate-control system having multiple compressors.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., refrigerant or carbon dioxide) between the indoor and outdoor heat exchangers. Efficient and reliable operation of the compressors is desirable to ensure that the climate-control system in which the compressor is installed is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a system that may include first and second compressors and first, second and third heat exchangers. The first heat exchanger may receive working fluid discharged from the first and second compressors. The second heat exchanger may be disposed downstream of the first heat exchanger and may provide working fluid to the first compressor. The third heat exchanger may be disposed between the first and second heat exchangers and may include an inlet and first and second outlets. The first outlet may provide working fluid to the second heat exchanger. The second outlet may provide working fluid to the second compressor.

In some embodiments, the first outlet may provide working fluid (directly or indirectly) to a suction inlet of said first compressor, and said second outlet may provide working fluid (directly or indirectly) to a suction inlet of said second compressor.

In some embodiments, the system may include a first expansion device disposed between the first and third heat exchangers. In some embodiments, the system may include a second expansion device disposed between the second and third heat exchangers.

In some embodiments, the system may include first and second fluid passageways. The first fluid passageway may extend from the first outlet of the third heat exchanger and through the second heat exchanger to an inlet of the first compressor. The second fluid passageway may extend from the second outlet of the third heat exchanger to an inlet of the second compressor.

In some embodiments, the third heat exchanger may include a flash tank. The first outlet may be a liquid outlet and the second outlet may be a vapor outlet.

In some embodiments, the second compressor may be a variable-capacity compressor. The capacity second compressor could be varied in any suitable manner, such as via digital modulation, for example, and/or any other manner.

In some embodiments, the system may include a bypass passageway extending from the second fluid passageway to a location of the first fluid passageway between the second heat exchanger and the inlet of the first compressor. The bypass passageway may include a valve controlling fluid-flow through the bypass passageway.

In some embodiments, the system may include a fourth heat exchanger in which heat is transferred between working fluid upstream of the inlet of the third heat exchanger and working fluid downstream of the second outlet of the third heat exchanger.

In some embodiments, the system may include a third expansion device and a fourth heat exchanger. The third expansion device may be disposed between the first expansion device and the first heat exchanger. The fourth heat exchanger may be disposed between the first and third expansion devices. The fourth heat exchanger may include an inlet, a first outlet in communication with the first expansion device, and a second outlet providing working fluid to an intermediate-pressure inlet of the first compressor. In some embodiments, the fourth heat exchanger may be a flash tank, for example. The first outlet of the fourth heat exchanger may be a liquid outlet and the second outlet of the fourth heat exchanger may be a vapor outlet.

In some embodiments, the system may include a control module controlling operation of the second compressor between first and second modes based on a fluid pressure within the third heat exchanger. The first mode may be a full capacity mode and the second mode may be a reduced capacity mode.

In some embodiments, the second compressor may be shut down during the second mode.

In some embodiments, the system may include first and second fluid passageways and a bypass passageway. The first fluid passageway may extend from the first outlet of the third heat exchanger and through the second heat exchanger to an inlet of the first compressor. The second fluid passageway may extend from the second outlet of the third heat exchanger to an inlet of the second compressor. The bypass passageway may extend from the second fluid passageway to a location of the first fluid passageway between the second heat exchanger and the inlet of the first compressor. The bypass passageway may include a valve controlling fluid-flow through the bypass passageway. The control module may control operation of the valve, such that the valve is in a closed position in the first mode and the valve is in an open position in the second mode.

In some embodiments, the control module may compare the fluid pressure with first and second setpoint pressures. The control module may operate the second compressor in the first mode when the fluid pressure is lower than the first and second setpoint pressures. The control module may operate the second compressor in the second mode when the fluid pressure is higher than the first and second setpoint pressures.

In some embodiments, the system may include first and second discharge lines extending from the first and second compressors, respectively. The first discharge line may be fluidly isolated from the second compressor. The second discharge line may be fluid isolated from the first compressor.

In some embodiments, the working fluid may be or include carbon dioxide, for example, or any other suitable working fluid or refrigerant.

In another form, the present disclosure provides a system that may include first, second and third fluid passageways. The first fluid passageway may receive working fluid from first and second compressors and may include a first heat exchanger. The system may also include a second heat exchanger having an inlet and first and second outlets. The inlet may receive working fluid from the first fluid passageway. The second fluid passageway may extend from the first outlet to an inlet of the first compressor and may include a third heat exchanger. The third fluid passageway may extend from the second outlet to an inlet of the second compressor.

In some embodiments, the first fluid passageway may include a first expansion device disposed upstream of the inlet of the second heat exchanger. The second fluid passageway may include a second expansion device disposed downstream of the first outlet of the second heat exchanger.

In some embodiments, the system may include a fourth heat exchanger in which heat is transferred between working fluid in the first fluid passageway and working fluid in the third fluid passageway.

In some embodiments, the system may include a fourth fluid passageway extending from the third fluid passageway to a location in the second fluid passageway between the third heat exchanger and the first compressor. The fourth fluid passageway may include a valve selectively allowing and restricting fluid communication between the second and third fluid passageways.

In some embodiments, the system may include a fifth fluid passageway fluidly isolated from the second and third fluid passageways and extending between the first fluid passageway and an intermediate-pressure inlet of the first compressor.

In some embodiments, the working fluid may be or include carbon dioxide, for example, or any other suitable working fluid or refrigerant.

In some embodiments, the second compressor is a variable-capacity compressor.

In another form, the present disclosure provides a method that may include providing a heat exchanger receiving working fluid from first and second compressors. Liquid working fluid may be separated from vapor working fluid in the heat exchanger. Liquid working fluid may be provided from the heat exchanger to a first fluid passageway that feeds the first compressor. Vapor working fluid may be provided from the heat exchanger to a second fluid passageway that feeds the second compressor. A capacity of the second compressor may be controlled based on a pressure of the vapor working fluid in the heat exchanger.

In some embodiments, the method may include comparing the pressure with first and second setpoint pressures and controlling the capacity of the second compressor based on the comparison.

In some embodiments, the second compressor may be operated in a high-capacity mode when the pressure is less than the first and second setpoint pressures. The second compressor may be operated in a reduced-capacity mode when the pressure is greater than the first and second setpoint pressures.

In some embodiments, the method may include providing the vapor working fluid to the first compressor when the pressure is greater than the first and second setpoint pressures.

In some embodiments, the method may include providing the vapor working fluid to the first compressor when the pressure is greater than a third setpoint pressure that is greater than the first and second setpoint pressures.

In some embodiments, the working fluid may be or include carbon dioxide, for example, or any other suitable working fluid or refrigerant.

In some embodiments, the method may include varying a capacity of the first compressor. The capacity of the first compressor may be varied by vapor injection and/or digital modulation, for example, and/or any other manner of capacity modulation.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
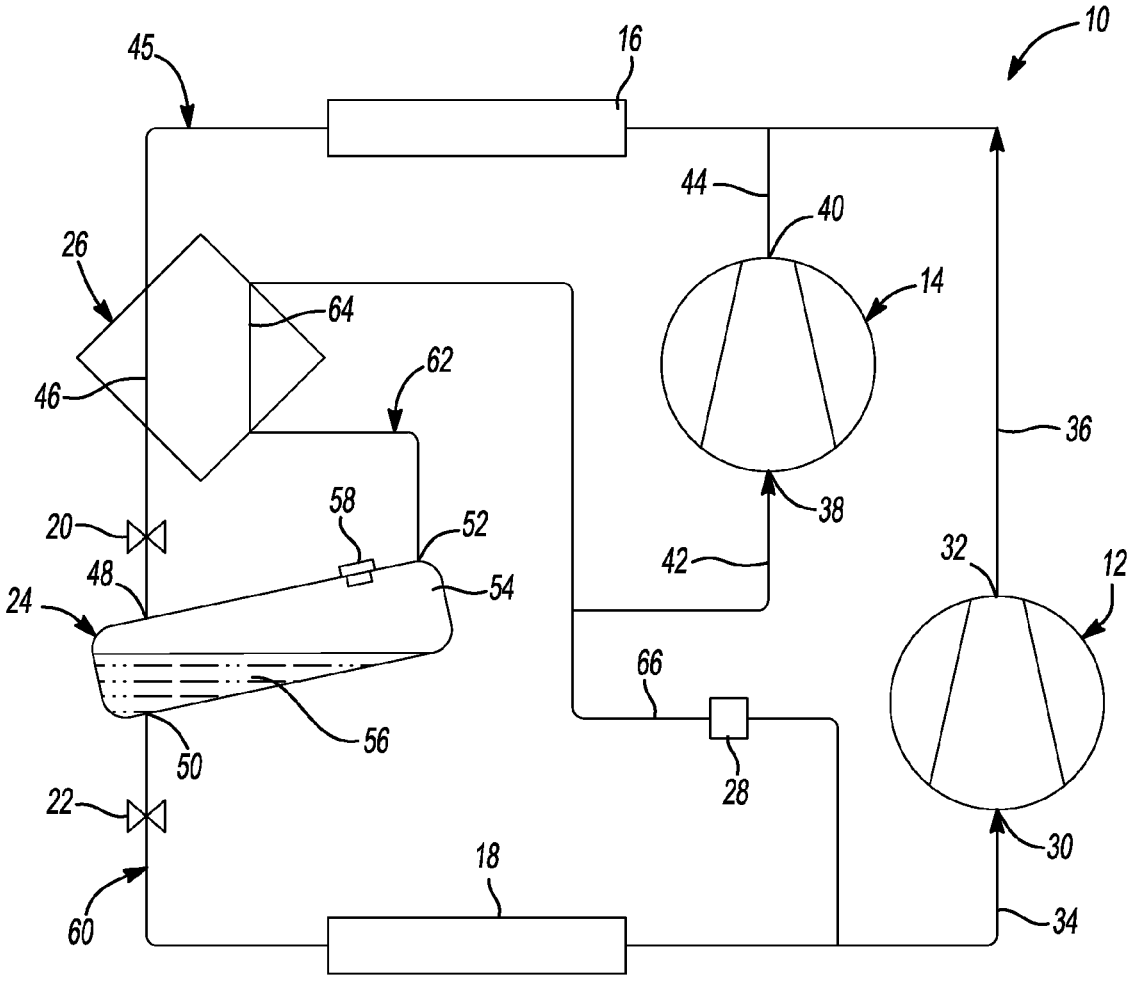
FIG. 1 is a schematic representation of a climate-control system according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a climate-control system 10 is provided that may include first and second compressors 12, 14, a first heat exchanger 16, a second heat exchanger 18, first and second expansion devices 20, 22, a flash tank 24, a third heat exchanger 26 and a bypass valve 28. The climate-control system 10 may be a heat-pump system, a refrigeration system, or an air conditioning system, for example. The first and second compressors 12, 14 may compress and circulate a working fluid (e.g., carbon dioxide or any other refrigerant) through the climate-control system 10 to heat or cool a space on demand.

One or both of the first and second compressors 12, 14 could be scroll compressors, for example, or any other types of compressors such as reciprocating or rotary vane compressors, for example. The first and second compressors 12, 14 could be of the same or different sizes and/or capacities. One or both of the first and second compressors 12, 14 may be a variable-capacity compressor operable in a full capacity mode and a reduced capacity mode. In some embodiments, the second compressor 14 could be a digitally modulated scroll compressor, for example, that is operable to selectively separate its orbiting and non-orbiting scrolls (not shown) to allow partially compressed working fluid to leak out of compression pockets formed by the scrolls, thereby reducing an operating capacity of the second compressor 14. It will be appreciated that the first compressor 12 could also be a digitally modulated compressor. In some embodiments, one or both of the first and second compressors 12, 14 could include additional or alternative capacity modulation capabilities (e.g., variable speed motor, vapor injection, blocked suction, etc.).

The first compressor 12 may include a first inlet 30 and a first outlet 32. The first inlet 30 may receive working fluid from a first suction line 34. Working fluid compressed in the first compressor 12 may be discharged through the first outlet 32 to a first discharge line 36. The second compressor 14 may include a second inlet 38 and a second outlet 40. The second inlet 38 may receive working fluid from a second suction line 42. Working fluid compressed in the second compressor 14 may be discharged through the second outlet 40 to a second discharge line 44. From the first and second discharge lines 36, 44, the compressed working fluid may flow into a first fluid passageway 45 that may include the first heat exchanger 16, a first conduit 46 of the third heat exchanger 26 and the first expansion device 20.

The first heat exchanger 16 may receive compressed working fluid from the first and second discharge lines 36, 44. The first heat exchanger 16 may be a condenser or gas-cooler and may transfer heat from the working fluid to ambient air that may be forced over the first heat exchanger 16 by a fan (not shown). In some embodiments, the first heat exchanger 16 may transfer heat from the working fluid to a stream of liquid such as water, for example. From the first heat exchanger 16, the working fluid may flow through a first conduit 46 of the third heat exchanger 26.

From the first conduit 46, the working fluid may flow through the first expansion device 20. The first expansion device 20 may be an electronic or thermal expansion valve or a capillary tube, for example. Working fluid downstream of the first expansion device 20 may have a lower pressure than working fluid upstream of the first expansion device 20.

From the first expansion device 20, the working fluid may flow into the flash tank 24. The flash tank 24 may include an inlet 48, a first outlet 50 and a second outlet 52. Liquid and vapor working fluid may separate from each other within the flash tank 24. For example, the vapor working fluid may accumulate in an upper portion 54 of the flash tank 24 and liquid working fluid may accumulate in a lower portion 56 of the flash tank 24. A pressure sensor 58 may be attached to the flash tank 24 to detect a fluid-pressure of the vapor working fluid in the upper portion 54 of the flash tank 24. In some embodiments, the flash tank 24 may be replaced with any other suitable heat exchanger operable to separate the liquid and vapor working fluid.

Liquid working fluid may exit the flash tank 24 through the first outlet 50 and flow into a second fluid passageway 60 that may include the second expansion device 22 and the second heat exchanger 18. From the first outlet 50, the liquid working fluid may flow through the second expansion device 22. The second expansion device 22 may be an electronic or thermal expansion valve or a capillary tube, for example. Working fluid downstream of the second expansion device 22 may have a lower pressure than working fluid upstream of the second expansion device 22.

From the second expansion device 22, the working fluid may flow through the second heat exchanger 18. The second heat exchanger 18 may be an evaporator in which working fluid may absorb heat from a space to be cooled. From the second heat exchanger 18, the working fluid may flow into the first suction line 34 and subsequently back into the first compressor 12 through the first inlet 30.

Vapor working fluid may exit the flash tank 24 through the second outlet 52 and flow into a third fluid passageway 62. The third fluid passageway 62 may extend between the second outlet 52 and the second suction line 42. Working fluid flowing through the third fluid passageway 62 may flow through a second conduit 64 of the third heat exchanger 26. Working fluid in the second conduit 64 may absorb heat from working fluid in the first conduit 46. From the second conduit 64, the working fluid may flow into the second suction line 42 and into the second compressor 14 through the second inlet 38.

In some embodiments, a bypass passageway 66 may provide selective fluid communication between the third fluid passageway 62 and the first suction line 34. The bypass valve 28 may be disposed in the bypass passageway 66 and may be movable between open and closed positions. In the closed position, the bypass valve 28 may restrict or prevent fluid-flow from the third fluid passageway 62 to the first suction line 34. In the open position, the bypass valve 28 may allow fluid to flow from the third fluid passageway 62 to the first suction line 34. It will be appreciated that the bypass valve 28 could be a solenoid valve, a mechanical valve actuated by fluid-pressure differentials, or an electronic expansion valve, for example, or any other type of valve.

Figure 2:
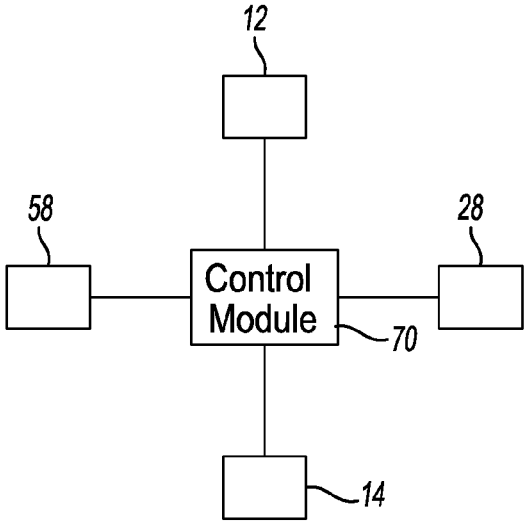
FIG. 2 is a block diagram illustrating communication between a control module and components of the climate-control system of FIG. 1.

As shown in FIG. 2, a control module 70 may be in communication with the first and second compressors 12, 14, the bypass valve 28 and the pressure sensor 58. The control module 70 may control operation of the first and second compressors 12, 14 and the bypass valve 28. Control of the second compressor 14 and the bypass valve 28 may be at least partially based on data that the control module 70 receives from the pressure sensor 58. Specifically, the control module 70 may digitally load and unload the second compressor 14 (i.e., increase and decrease the capacity of the second compressor 14) based on the data received from the pressure sensor 58.

In some embodiments, for example, the control module 70 may compare a pressure measurement received from the pressure sensor 58 with first and second predetermined setpoint values. When the pressure detected by the pressure sensor 58 is greater than the first and second setpoint values or equal to a higher one of the first and second setpoint values, the control module 70 may unload the second compressor 14 (i.e., operate the second compressor 14 in a reduced capacity mode). When the pressure detected by the pressure sensor 58 is less than the first and second setpoint values or equal to a lower one of the first and second setpoint values, the control module 70 may load the second compressor 14 (i.e., operate the second compressor 14 in a full or increased capacity mode).

When ambient air temperatures are sufficiently low, working fluid entering the flash tank 24 may be at a subcritical pressure; and therefore, only a small amount of vapor may be separated from the liquid working fluid in the flash tank 24. Under such circumstances, the control module 70 may shutdown the second compressor 14 and open the bypass valve 28 to allow vapor in the third fluid passageway 62 to flow into the first suction line 34 and into the first compressor 12. In some embodiments, the control module 70 may open the bypass valve 28 when the pressure measured by the pressure sensor 58 is at or above a third setpoint value that is higher than the first and second setpoint values.

In some embodiments, the control module 70 may control operation of the first and second compressors 12, 14 and/or the bypass valve 28 based on additional or alternative system operating parameters and/or compressor operating parameters, for example.

Figure 3:
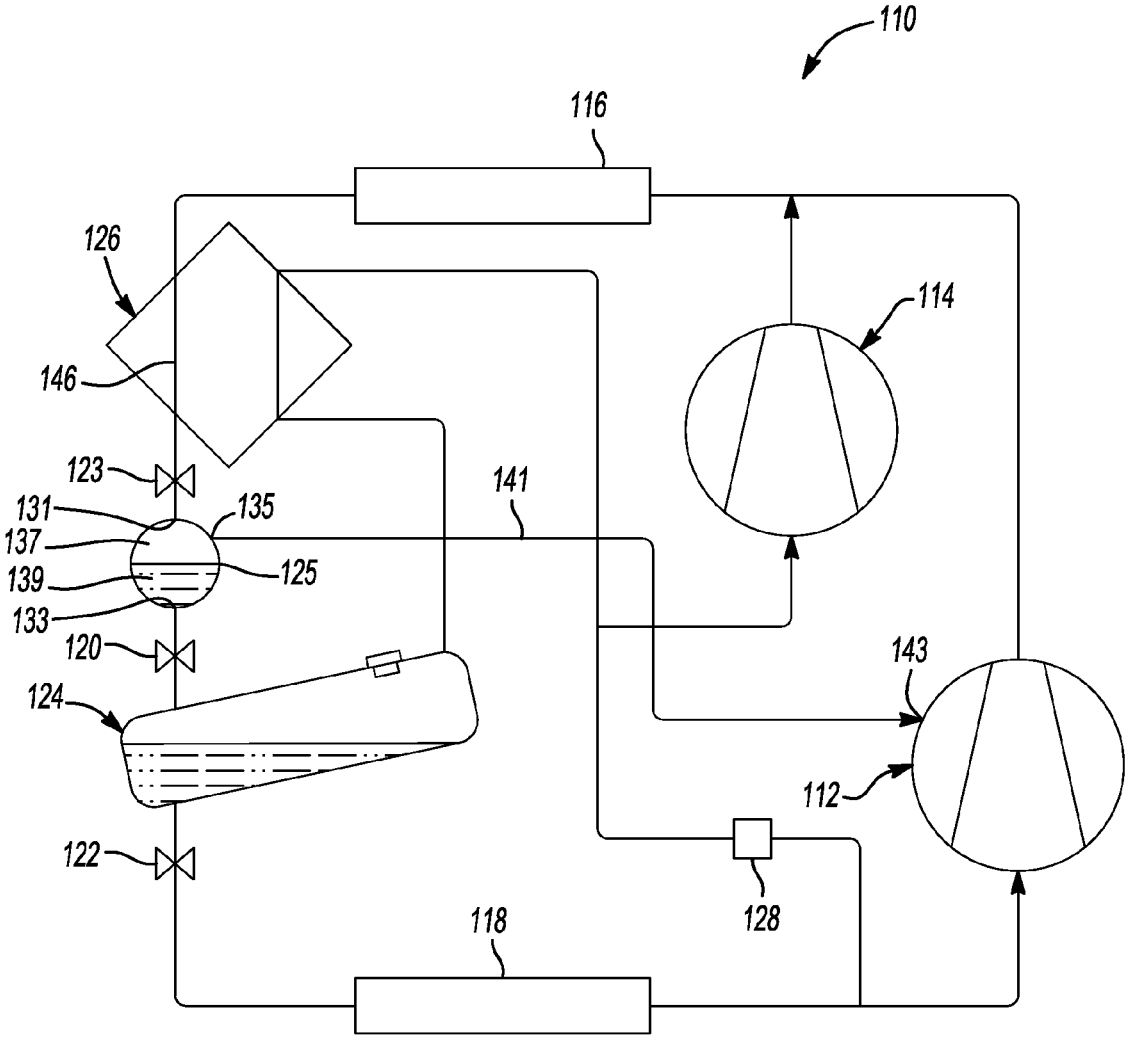
FIG. 3 is a schematic representation of another climate-control system according to the principles of the present disclosure.

With reference to FIG. 3, another climate-control system 110 is provided that may be generally similar to the climate-control system 10 described above, apart from any exceptions noted below. The climate-control system 110 may include first and second compressors 112, 114, a first heat exchanger 116, a second heat exchanger 118, first and second expansion devices 120, 122, a first flash tank 124, a third heat exchanger 126, a bypass valve 128 and a control module (not shown). The structure and function of the first and second compressors 112, 114, first heat exchanger 116, second heat exchanger 118, first and second expansion devices 120, 122, first flash tank 124, third heat exchanger 126, bypass valve 128 and control module may be similar or identical to that of the first and second compressors 12, 14, first heat exchanger 16, second heat exchanger 18, first and second expansion devices 20, 22, flash tank 24, third heat exchanger 26, bypass valve 28, and control module 70, respectively, described above, and therefore, will not be described again in detail.

The climate-control system 110 may also include a third expansion device 123 and a second flash tank 125. The third expansion device 123 may be disposed between a first conduit 146 of the third heat exchanger 126 and the first expansion device 120. The third expansion device 123 may be an electronic or thermal expansion valve or a capillary tube, for example. Working fluid downstream of the third expansion device 123 may have a lower pressure than working fluid upstream of the third expansion device 123.

The second flash tank 125 may be disposed between the first and third expansion devices 120, 123 and may include an inlet 131, a first outlet 133 and a second outlet 135. Liquid and vapor working fluid may separate from each other within the second flash tank 125 such that the vapor working fluid may accumulate in an upper portion 137 of the second flash tank 125 and liquid working fluid may accumulate in a lower portion 139 of the second flash tank 125. In some embodiments, the second flash tank 125 may be replaced with any other suitable heat exchanger operable to separate the liquid and vapor working fluid.

Liquid working fluid may exit the second flash tank 125 through the first outlet 133 and may subsequently flow through the first expansion device 120 and into the first flash tank 124. Vapor working fluid may exit the second flash tank 125 through the second outlet 135 and may flow through a vapor-injection passageway 141. From the vapor-injection passageway 141, the working fluid may flow through an intermediate-pressure inlet 143 of the first compressor 112. From the intermediate-pressure inlet 143, the working fluid may be injected into an intermediate-pressure location (not shown) of a compression mechanism of the first compressor 112. For example, the intermediate-pressure location may be a compression pocket defined by orbiting and non-orbiting scrolls (not shown) at a location between a suction inlet and a discharge outlet of the compression mechanism. In some embodiments, a valve (not shown) may be disposed in the vapor-injection passageway 141 and may selectively open and close to control fluid-flow to the intermediate-pressure inlet 143 of the first compressor 112 to vary the capacity of the first compressor 112.

In this application, the term "module" may be replaced with the term circuit. The term "module" may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A system comprising:

a first compressor;

a second compressor;

a first heat exchanger receiving working fluid discharged from said first and second compressors;

a second heat exchanger disposed downstream of said first heat exchanger and providing working fluid to said first compressor;

a third heat exchanger disposed between said first and second heat exchangers and including an inlet and first and second outlets, said first outlet providing working fluid to said second heat exchanger, said second outlet providing working fluid to said second compressor; and a control module controlling operation of said second compressor between first and second modes based on a fluid pressure within said third heat exchanger, wherein said first mode is a full capacity mode and said second mode is a reduced capacity mode.

2. The system of claim 1, wherein said working fluid received in said second heat exchanger from said first outlet is provided from said second heat exchanger to a suction inlet of said first compressor.

3. The system of claim 2, wherein said second outlet provides working fluid to a suction inlet of said second compressor.

4. The system of claim 1, further comprising an expansion device disposed between said first and third heat exchangers.

5. The system of claim 4, further comprising another expansion device disposed between said second and third heat exchangers.

6. The system of claim 1, further comprising:

a first fluid passageway extending from said first outlet of said third heat exchanger and through said second heat exchanger to an inlet of said first compressor; and a second fluid passageway extending from said second outlet of said third heat exchanger to an inlet of said second compressor.

7. The system of claim 6, wherein said third heat exchanger includes a flash tank, and wherein said first outlet is a liquid outlet and said second outlet is a vapor outlet.

8. The system of claim 7, wherein said second compressor is a variable-capacity compressor.

9. The system of claim 8, wherein said second compressor is a digitally modulated compressor.

10. The system of claim 7, further comprising a bypass passageway extending from said second fluid passageway to a location of said first fluid passageway between said second heat exchanger and said inlet of said first compressor, said bypass passageway including a valve controlling fluid-flow through said bypass passageway.

11. The system of claim 10, further comprising first and second expansion devices, said first expansion device disposed between said first and third heat exchangers, said second expansion device disposed between said second and third heat exchangers.

12. The system of claim 11, further comprising a fourth heat exchanger in which heat is transferred between working fluid upstream of said inlet of said third heat exchanger and working fluid downstream of said second outlet of said third heat exchanger.

13. The system of claim 11, further comprising:

a third expansion device disposed between said first expansion device and said first heat exchanger; and a fourth heat exchanger disposed between said first and third expansion devices, said fourth heat exchanger including an inlet, a first outlet in communication with said first expansion device, and a second outlet providing working fluid to an intermediate-pressure inlet of said first compressor.

14. The system of claim 13, wherein said fourth heat exchanger is a flash tank, and wherein said first outlet of said fourth heat exchanger is a liquid outlet and said second outlet of said fourth heat exchanger is a vapor outlet.

15. The system of claim 1, wherein said second compressor is shut down during said second mode.

16. The system of claim 15, further comprising:

a first fluid passageway extending from said first outlet of said third heat exchanger and through said second heat exchanger to an inlet of said first compressor;

a second fluid passageway extending from said second outlet of said third heat exchanger to an inlet of said second compressor; and a bypass passageway extending from said second fluid passageway to a location of said first fluid passageway between said second heat exchanger and said inlet of said first compressor, said bypass passageway including a valve controlling fluid-flow through said bypass passageway, wherein said control module controls operation of said valve, such that said valve is in a closed position in said first mode and said valve is in an open position in said second mode.

17. The system of claim 16, wherein said working fluid is carbon dioxide.

18. The system of claim 1, wherein said control module compares said fluid pressure with first and second setpoint pressures, said control module operates said second compressor in said first mode when said fluid pressure is lower than said first and second setpoint pressures, said control module operates said second compressor in said second mode when said fluid pressure is higher than said first and second setpoint pressures.

19. The system of claim 1, further comprising first and second discharge lines extending from said first and second compressors, respectively, said first discharge line being fluidly isolated from said second compressor, said second discharge line being fluid isolated from said first compressor.

20. A system comprising:

a first fluid passageway receiving working fluid from first and second compressors and including a first heat exchanger;

a second heat exchanger including an inlet and first and second outlets, said inlet receiving working fluid from said first fluid passageway;

a second fluid passageway extending from said first outlet to an inlet of said first compressor and including a third heat exchanger;

a third fluid passageway extending from said second outlet to an inlet of said second compressor; and a control module controlling operation of said second compressor between first and second modes based on a fluid pressure within said second heat exchanger, wherein said first mode is a full capacity mode and said second mode is a reduced capacity mode.

21. The system of claim 20, wherein said first fluid passageway includes a first expansion device disposed upstream of said inlet of said second heat exchanger, and wherein said second fluid passageway includes a second expansion device disposed downstream of said first outlet of said second heat exchanger.

22. The system of claim 20, further comprising a fourth heat exchanger in which heat is transferred between working fluid in said first fluid passageway and working fluid in said third fluid passageway.

23. The system of claim 20, further comprising a fourth fluid passageway extending from said third fluid passageway to a location in said second fluid passageway between said third heat exchanger and said first compressor, said fourth fluid passageway including a valve selectively allowing and restricting fluid communication between said second and third fluid passageways.

24. The system of claim 23, further comprising a fifth fluid passageway fluidly isolated from said second and third fluid passageways and extending between said first fluid passageway and an intermediate-pressure inlet of said first compressor.

25. The system of claim 20, wherein the working fluid is carbon dioxide.

26. The system of claim 20, wherein said second compressor is a variable-capacity compressor.

27. A system comprising:

a first fluid passageway receiving working fluid from first and second compressors and including a first heat exchanger;

a second heat exchanger including an inlet and first and second outlets, said inlet receiving working fluid from said first fluid passageway;

a second fluid passageway extending from said first outlet to an inlet of said first compressor and including a third heat exchanger;

a third fluid passageway extending from said second outlet to an inlet of said second compressor;

a fourth fluid passageway extending from said third fluid passageway to a location in said second fluid passageway between said third heat exchanger and said first compressor, said fourth fluid passageway including a valve selectively allowing and restricting fluid communication between said second and third fluid passageways; and a fifth fluid passageway fluidly isolated from said second and third fluid passageways and extending between said first fluid passageway and an intermediate-pressure inlet of said first compressor.

* * * * *